United States Patent [19]

Eichinger

[11] 4,402,675

[45] Sep. 6, 1983

[54] OUTBOARD MOTOR TILT MECHANISM

[75] Inventor: Charles H. Eichinger, Oshkosh, Wis.

[73] Assignee: Brunswick Corporation, Skokie, Ill.

[21] Appl. No.: 268,227

[22] Filed: May 29, 1981

[51] Int. Cl.[3] ..... B63H 21/26

[52] U.S. Cl. ..... 440/53; 248/643

[58] Field of Search ..... 248/640, 642, 643; 440/53, 55, 56, 58-65

[56] References Cited

U.S. PATENT DOCUMENTS

| | | | |
|---|---|---|---|
| 2,684,044 | 7/1954 | Kiekhaefer | 29/751 |
| 2,954,950 | 10/1960 | Hart | 248/642 |
| 3,511,460 | 5/1970 | Shimanckas | 440/53 |
| 3,666,218 | 5/1972 | Hagen | 248/642 |
| 3,785,329 | 1/1974 | Shimanckas | 440/55 |
| 3,902,449 | 9/1975 | Berry | 440/55 |
| 4,013,249 | 3/1977 | Meyer | 248/642 |
| 4,099,479 | 7/1978 | Arimitsu | 440/63 |

*Primary Examiner*—Sherman D. Basinger
*Attorney, Agent, or Firm*—O. T. Sessions

[57] ABSTRACT

The invention provides an outboard motor tilt mechanism for releasably supporting the propulsion unit in several elevated positions. A swivel bracket (16) is pivotally supported on a transom bracket (11) to provide tilting movement. A support arm (17) pivotally attached to the transom bracket (11) has an elongated slot slidably engaging a locking pin (21) fixed to the swivel bracket (16). A control handle (25) controls the tension on spring (28) to either permit or prevent engagement of the locking pin (21) with locking recesses (22, 23, 24) in the support arm (17).

5 Claims, 5 Drawing Figures

OUTBOARD MOTOR TILT MECHANISM

TECHNICAL FIELD

This invention relates to outboard motors and particularly to mechanisms for releasably supporting the propulsion unit in elevated positions.

BACKGROUND ART

Outboard motors usually include a transom bracket for attachment to the transom of a boat and a swivel bracket pivotally connected to the transom bracket to provide tilting movement about a generally horizontal tilt axis. Frequently mechanisms are included to retain the swivel bracket in a raised position and a partially raised or shallow-water drive position intermediate between the raised position and the normal running position to allow operation in shallow water. One such device, having distinct mechanisms for the raised and shallow-water drive positions, is disclosed in U.S. Pat. No. 3,902,449 to Berry. Another device utilizing a support arm attached to the transom bracket to support the swivel bracket in a raised position is illustrated in U.S. Pat. No. 3,666,218 to Hagen. Several other mechanisms for supporting a swivel bracket in raised positions are shown in U.S. Pat. No. 4,099,479 to Arimitsu, No. 3,785,329 to Shimanckas, No. 3,511,460 to Shimanckas, and No. 2,684,044 to Kiekhaefer.

DISCLOSURE OF INVENTION

The invention provides a tilt mechanism for a marine propulsion device which has a transom bracket for attachment to a boat and a swivel bracket pivotally connected to the transom bracket for movement about a generally horizontal tilt axis. A support arm pivotally attached to the transom bracket has an elongated slot which slidably engages a locking pin fixed to the swivel bracket. The slot in the support arm includes a locking recess offset to one side of the slot which may be selectively forced into engagement with the locking pin by a spring attached to the support arm and a control lever. The control lever is mounted on the transom bracket in a convenient position and can be moved between a first position permitting the spring to force the locking recess into engagement with the locking pin and a second position preventing engagement. This arrangement permits location of the control lever on the transom bracket and provides two positions for the control lever fixed relative to the transom bracket.

The control lever is preferably pivotally attached to the transom bracket with the spring providing an over-center action on the lever to hold it in either the first or second position.

Additional locking recesses may be provided in the support arm slot to provide more than one raised position for the swivel bracket such as shallow-water drive positions and a fully elevated position.

BEST MODE FOR CARRYING OUT THE INVENTION

Figure 1:
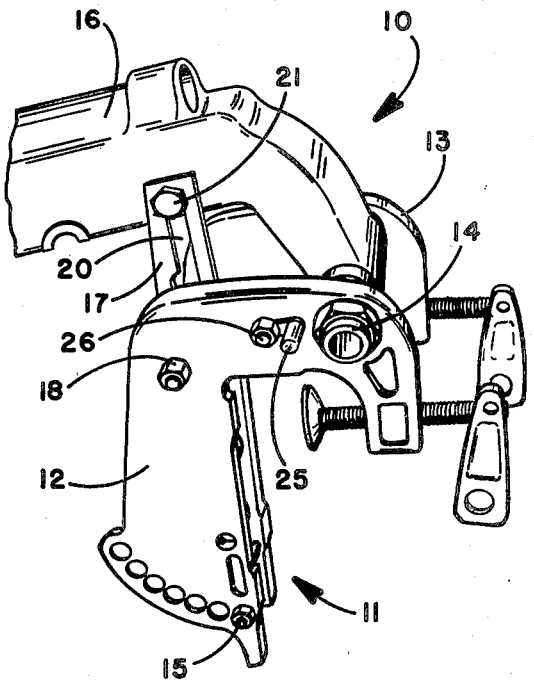
FIG. 1 is a perspective view of a tilt mechanism incorporating the features of the invention with the swivel bracket in the elevation position.

The tilt mechanism 10 shown in the figures includes a transom bracket assembly 11 having screw clamps for attachment to the transom of a boat. The transom bracket 11 includes right and left clamping members 12 and 13 held in spaced relationship by a pivot tube 14 and a spacer bar 15. A swivel bracket 16 is mounted on the transom bracket 11 by the pivot tube 14 for tilting movement about a horizontal tilt axis. The outboard drive unit, not illustrated, is mounted on the swivel bracket 16 in a conventional manner to provide steering about a generally vertical steering axis.

A support arm 17 is mounted between one of the clamping members 12 and the swivel bracket 16 to support the swivel bracket 16 in a full-tilt position and intermediate or shallow-water drive positions. The support arm 17 is pivotally attached to the clamp member 12 by a nut 18 and shoulder bolt 19. An elongated slot 20 in the support arm 17 engages a locking pin or shoulder bolt 21 attached to the swivel bracket 16. In the preferred embodiment the support arm 17 includes three locking recesses 22, 23, and 24 to engage the locking pin and provide a full-tilt position and two shallow-water drive positions for the outboard drive unit. The slot 20 in the support arm 17 includes two straight sections at an angle to each other to allow the support arm to be positioned near the boat transom in the lowest drive position.

Figure 2:
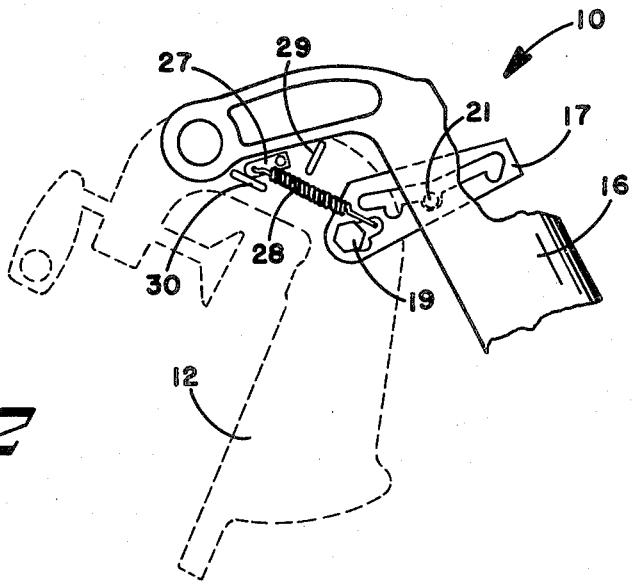
FIG. 2 is a schematic side view of the assembly of FIG. 1 showing an intermediate tilt position.

A control handle 25 is mounted on one end of a shaft 26 rotatably mounted in the clamping member 12 to provide operating control of the mechanism. A control lever 27 is attached to the other end of the shaft 26. A coil spring 28 having one end attached to the control lever 27 and the other end attached to the support arm 17, provides a force on both the control lever 27 and the support arm 17. The coil spring 28, which always acts in tension, provides an over-center action on the control lever 27 as it is rotated between the tilt-up positions shown in FIG. 2 and FIG. 4 and the tilt-down position shown in FIG. 3. Rotation of the control lever 27 is limited by two stops 29 and 30 formed on the inside of the clamping member. The coil spring 28 also provides an over-center action on the support arm 17. Thus when the swivel bracket 16 is in positions below the shallow-water drive positions, the spring 28 will provide a disengaging force on the support arm 17, whereas, when the swivel bracket 16 is in an elevated position, the spring 28 will provide an engaging action on the support arm 17 to engage the locking pin 21 with one of the locking recesses 22, 23 and 24. A helical torsion spring 31 is mounted between the clamping member 12 of the transom bracket 11 and the support arm 17 to provide a further disengaging force on the support arm 17 to prevent the support arm 17 from engaging the locking pin 21 when the control lever 27 is in the tilt-down position. This arrangement allows the control handle 25 to be conveniently located on the side of the clamp bracket 11 where it is easily accessible when the engine is tilted or turned. The control handle 25 is thus always in the same location relative to the boat since it is attached to the clamp bracket 11.

Figure 3:
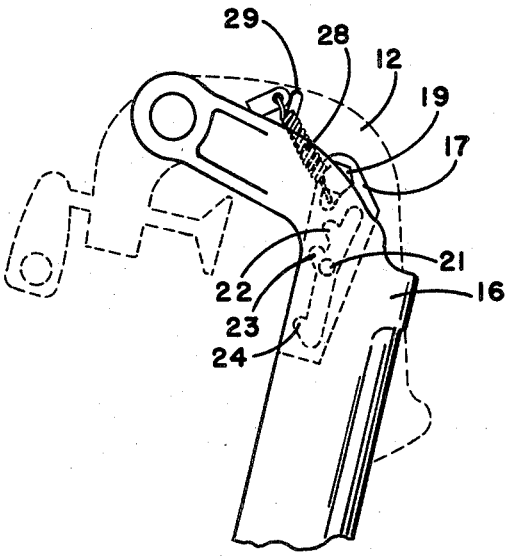
FIG. 3 is a schematic view showing a normal running position.
Figure 4:
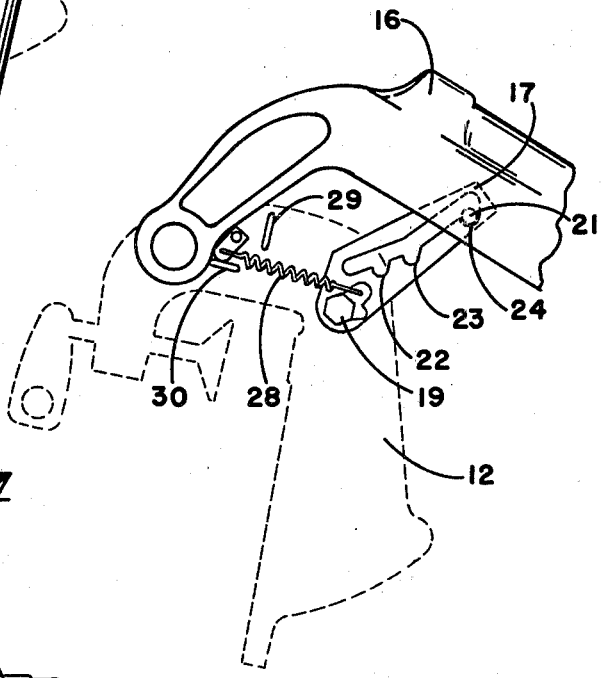
FIG. 4 is a schematic view showing the full tilt position.
Figure 5:
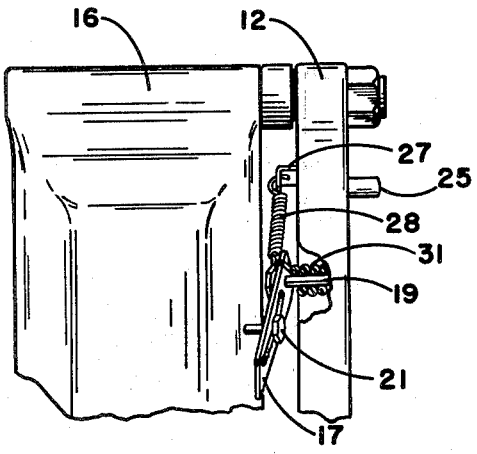
FIG. 5 is a partial rear view showing details of the tilt mechanism.

To raise and lock the swivel bracket 11 from the normal operation position shown in FIG. 3 to an elevated position, the control handle 25 is first rotated to the tilt-up position to increase the tension on the coil spring 28. Then the operator may raise the unit upward. The increased tension on the coil spring 28 will overcome the force applied by the helical torsion spring 31 to engage the slots 22, 23, and 24 in the support arm with the locking pin 21. The geometry of the shallow-water drive locking recess allows the locking pin 21 to slide past the recesses as the unit is raised. By simply raising the unit to the desired position and releasing it, the unit will engage one of the locking recesses 22, 23, or 24 and remain in that position. To lower the drive unit and the swivel bracket 16, the control handle 25 is rotated to the tilt-down position thereby reducing the tension on the coil spring 28. The operator may then raise the swivel bracket 16 slightly to disengage the locking recess and locking pin 21 and lower the unit to the normal drive position.

I claim:

1. A tilt mechanism for a marine propulsion device comprising:

(A) A transom bracket for attachment to a boat;

(B) A swivel bracket pivotally connected to said transom bracket for pivotal movement about a first generally horizontal tilt axis;

(C) A support arm pivotally attached to rotate about a pivot axis on said transom bracket and having an elongated slot, said slot including a first locking recess offset to one side of said slot;

(D) A locking pin on said swivel bracket, said pin slidably engaging said slot;

(E) A first spring means attached to said support arm to selectively force said locking recess into engagement with said locking pin;

(F) A control lever mounted on said transom bracket and attached to said first spring means to selectively move said first spring means between a first position permitting said first spring means to force said locking recess into engagement with said locking pin and a second position preventing engagement of said locking pin and said locking recess; and (G) A second spring means attached to said transom bracket and said support arm to provide a force in a direction opposing engagement of said locking recess with said locking pin.

2. The tilt mechanism defined in claim 1 wherein said control lever is positioned to provide an over-center action with said first spring when said lever is moved between its first and its second position.

3. The tilt mechanism defined in claim 2 wherein said control lever is located generally between said tilt axis and said pivot axis.

4. The tilt mechanism defined in claim 1 wherein said elongated slot in said support arm further comprises a second locking recess offset to said one side of said slot.

5. The tilt mechanism defined in claim 1 wherein said first spring means and said control lever are positioned to provide a force opposing engagement of said locking recess with said locking pin when said locking pin is below a line extending approximately between said tilt axis and said pivot axis.

* * * * *